US008496451B2

(12) United States Patent
Hale et al.

(10) Patent No.: US 8,496,451 B2
(45) Date of Patent: Jul. 30, 2013

(54) PUMP DIAPHRAGM

(75) Inventors: Nathan Earl Hale, Grand Terrace, CA (US); David Brian McCall, Perris, CA (US); Wallace Christian Wiitkoff, La Grange, KY (US); Robert Foster Jack, Riverside, CA (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 425 days.

(21) Appl. No.: 12/819,472

(22) Filed: Jun. 21, 2010

(65) Prior Publication Data

US 2011/0311379 A1 Dec. 22, 2011

(51) Int. Cl.
*F04B 45/053* (2006.01)

(52) U.S. Cl.
USPC .... 417/395; 417/393; 417/413.1; 92/103 SD; 92/103 R

(58) Field of Classification Search
USPC ..... 417/393, 395, 413.1; 92/99, 103 R, 92/103 SD
See application file for complete search history.

(56) References Cited

U.S. PATENT DOCUMENTS

| | | | | |
|---|---|---|---|---|
| 4,238,992 | A | 12/1980 | Tuck, Jr. | 92/103.5 D |
| 4,247,264 | A | 1/1981 | Wilden | 417/393 |
| 4,270,441 | A | 6/1981 | Tuck, Jr. | 92/102 |
| D275,858 | S | 10/1984 | Wilden | D15/7 |
| 4,549,467 | A | 10/1985 | Wilden et al. | 91/307 |
| D294,946 | S | 3/1988 | Wilden | D15/7 |
| D294,947 | S | 3/1988 | Wilden | D15/7 |
| 5,169,296 | A | 12/1992 | Wilden | 417/395 |
| 5,634,391 | A * | 6/1997 | Eady | 92/97 |
| 5,687,633 | A * | 11/1997 | Eady | 92/97 |
| 5,743,170 | A | 4/1998 | Pascual et al. | 92/103 F |
| 5,957,670 | A | 9/1999 | Duncan et al. | 417/395 |
| 6,102,363 | A | 8/2000 | Eberwein | 251/63 |
| 6,230,609 | B1 * | 5/2001 | Bender et al. | 92/99 |
| 6,257,845 | B1 | 7/2001 | Jack et al. | 417/395 |
| 6,343,539 | B1 * | 2/2002 | Du | 92/100 |
| 6,357,723 | B2 | 3/2002 | Kennedy et al. | 251/322 |
| 6,435,845 | B1 * | 8/2002 | Kennedy et al. | 417/395 |
| 7,063,516 | B2 | 6/2006 | Bethel | 417/395 |
| 7,125,229 | B2 | 10/2006 | Distaso et al. | 417/395 |
| 7,399,168 | B1 | 7/2008 | Eberwein | 417/395 |

OTHER PUBLICATIONS

Prior Art Wilden 2.68" Diaphragm Mar. 12, 2009.

* cited by examiner

*Primary Examiner* — Peter J Bertheaud
*Assistant Examiner* — Dominick L Plakkoottam
(74) *Attorney, Agent, or Firm* — Novak Druce Connolly Bove + Quigg LLP

(57) ABSTRACT

A diaphragm assembly for a fluid driven diaphragm pump includes a piston having an inflexible core. This core includes a hub with a plate extending radially from about the periphery of the hub. The piston further includes a unitary diaphragm body molded with the inflexible core in situ. The unitary diaphragm body has a plurality of connective tendons extending through the plate. A thermoplastic coating extends about the inflexible core between the core and the molded unitary diaphragm body having a thermally miscible surface with the thermoplastic coating. An inflexible backing plate extends in juxtaposition with the diaphragm.

13 Claims, 1 Drawing Sheet

PUMP DIAPHRAGM

BACKGROUND OF THE INVENTION

The field of the present invention is diaphragms for fluid driven diaphragm pumps.

Air driven double diaphragm pumps employ a source of pressurized air for operation and are quite versatile in their ability to pump a wide variety of materials. Pumps having double diaphragms driven by compressed air directed through an actuator valve are found in U.S. Pat. Nos. 7,399,168; 7,063,516; 6,435,845; 6,357,723; 6,257,845; 5,957,670; 5,169,296; 4,247,264; Des. 294,946; Des. 294,947; and Des. 275,858. Actuator valves used in such pumps are illustrated in the foregoing and in U.S. Pat. Nos. 7,125,229; 6,102,363; 4,549,467. Diaphragms used in such pumps are illustrated in the foregoing pump patents and in U.S. Pat. Nos. 5,743,170; 4,270,441; 4,238,992. The disclosures of the foregoing patents and published application are incorporated herein by reference. Pressurized fluids other than air may be employed to drive these devices. If liquids are used, alternate valve arrangements would be appropriate.

Such pumps include an air chamber housing having a center section and two concave discs facing outwardly from the center section. Pump chamber housings oppose the two concave discs. The pump chamber housings are coupled with an inlet manifold and an outlet manifold through ball check valves positioned in the inlet passageways and outlet passageways from and to the inlet and outlet manifolds, respectively. Diaphragms extend outwardly to mating surfaces between the concave discs and the pump chamber housings. The diaphragms with the concave discs and with the pump chamber housings each define an air chamber and a pump chamber to either side thereof. At the centers thereof, the diaphragms are fixed to a control shaft by pump pistons. The control shaft slidably extends through the air chamber housing.

Actuator valves associated with such pumps include feedback control mechanisms. Such mechanisms typically have airways on the control shaft attached to the diaphragms and a valve piston. Pressurized air is supplied to the valve piston. This pressurized air is alternately distributed to the air chambers through the valve piston. The valve piston is controlled by control shaft or pump piston location which in turn is controlled by distribution of air through the valve piston. The resulting alternating pressurized air drives the diaphragms back and forth. In turn, the pump chambers alternately expand and contract to pump material there through. Such pumps are capable of pumping a wide variety of materials of greatly varying consistency.

The diaphragms used in such pumps have been made in a variety of shapes and constructions. Diaphragms can be molded flexible plates sandwiched between rigid external piston plates or, alternatively, integral bodies including a rigid piston integral with an annular flexure portion, among others. Molded diaphragms have been formed with a central piston and a flexible peripheral portion concave toward the air side. A rigid body forms the interior of the piston with a unitary covering including the peripheral portion molded about the rigid body in situ. The rigid body may be thermoplastic with the unitary covering being of thermoplastic elastomer thermally miscible with the thermoplastic coating. An insert, made of rigid material, is located at the hub and has a center attachment with a threaded bore accessible from one side of the diaphragm and a plurality of radially outwardly extending engagement flanges displaced from one another and embedded in the rigid body. The expected life of diaphragms used in air driven devices contemplates vast numbers of cycles, alternating pressures, tensions and flexures. Because of these expectations, the molded diaphragms have maximum utility in small sizes where robust pistons are more easily accommodated and the composite structures can better withstand the cycling under less destructive forces.

SUMMARY OF THE INVENTION

The present invention is directed to a diaphragm assembly designed for employment in a fluid driven diaphragm pump. The assembly includes a piston having an inflexible core. This core includes a hub with a plate extending radially from about the periphery of the hub and a center attachment concentrically arranged in the hub and accessible from a first end of the hub. The plate defines the inflexibility of the piston. The piston further includes a unitary diaphragm body molded with the inflexible core in situ. A peripheral portion outwardly of the piston is integrally molded with the unitary diaphragm body.

In a first separate aspect of the present invention, the unitary diaphragm body has a plurality of connective tendons extending through the plate. These tendons tie the material on each side of the piston together in close relationship with the inflexible core. The tendons extend through holes in the inflexible core which also facilitate molding.

In a second separate aspect of the present invention, a thermoplastic coating extends about the inflexible core between the core and the molded unitary diaphragm body. The unitary diaphragm body is of thermoplastic elastomer having at least a thermally miscible surface with the thermoplastic coating. The rigidity of the thermoplastic coating further retains the outer elastomer fast about the inflexible core.

In a third separate aspect of the present invention, the unitary diaphragm body between the periphery of the circular plate and the portion has an annular ring portion of greater cross-sectional thickness than the peripheral portion. This structure adds integrity to the diaphragm between the piston and the peripheral portion.

In a fourth separate aspect of the present invention, the first end of the hub including a mounting surface with a threaded hole as a center attachment extending through the mounting surface. A pump shaft has a threaded end engaged with the threaded hole and a shoulder. An inflexible backing plate is held between the mounting surface and the shoulder on the pump shaft and extends in juxtaposition with the diaphragm outwardly to the annular ring portion for further structural support.

In a fifth separate aspect of the present invention, any of the foregoing separate aspects may be combined to further advantage.

Accordingly, it is an object of the present invention to provide an improved diaphragm for a fluid driven diaphragm pump. Other and further objects and advantages will appear hereinafter.

DETAILED DESCRIPTION OF THE PREFERRED EMBODIMENT

Figure 3:
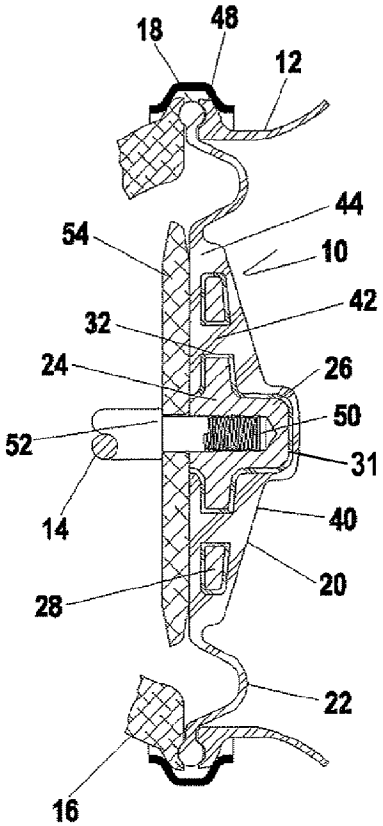
FIG. 3 is a cross-sectional side view of the diaphragm assembled with an inflexible backing plate and a pump shaft.
Figure 2:
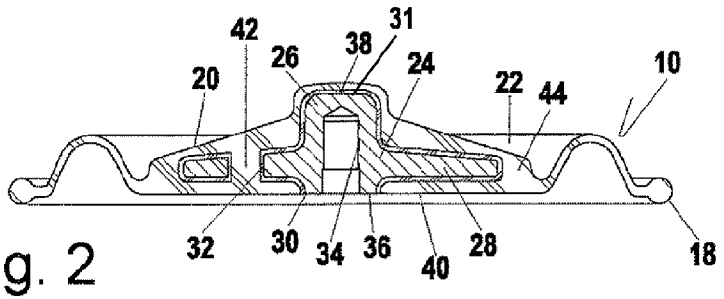
FIG. 2 is a cross-sectional view of the diaphragm taken through line 2-2 of FIG. 1.
Figure 1:
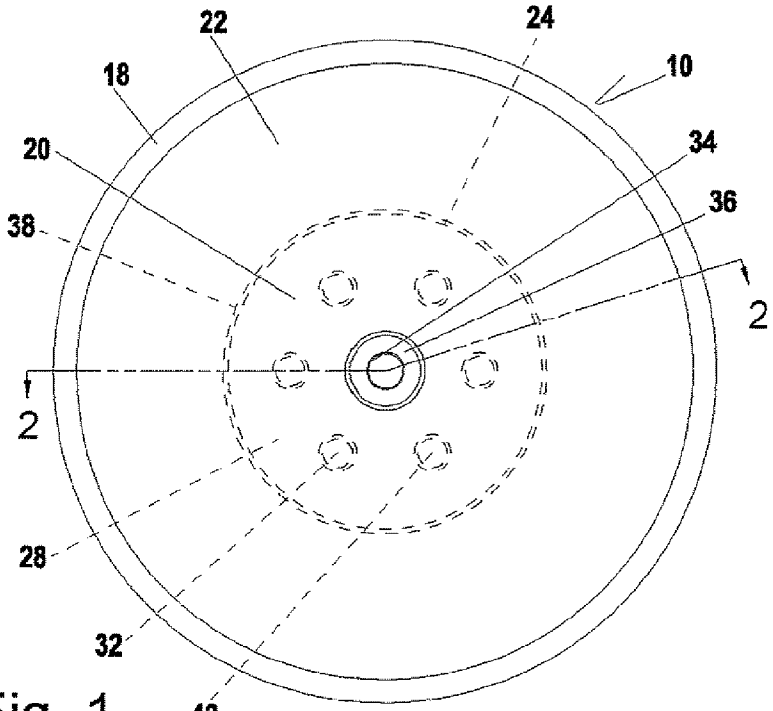
FIG. 1 is a plan view of the attachment side of a diaphragm.

Turning in detail the drawings, a diaphragm assembly is contemplated to be employed with an air driven diaphragm pump 12 (partially illustrated). In such a pump, the periphery of a diaphragm 10 is retained while the center of the diaphragm 10 is associated with an oscillating pump shaft 14. The diaphragm assembly faces a fluid chamber defined on the pump 12 as part of an actuator 16 (partially illustrated). This chamber alternately imposes pressure and venting to atmosphere to oscillate the diaphragm assembly. On the other side of the diaphragm assembly, the pump chamber alternately intakes and exhausts pumped material motivated by the oscillating diaphragm assembly.

Looking in gross at the diaphragm 10, it includes an outer bead 18, a piston 20 and a flexible peripheral portion 22 concave toward the air side located between the piston 20 and the outer bead 18. The outer bead 18 and the peripheral portion 22 are of conventional construction in the present embodiment. These diaphragms 10 are contemplated to be up to and in excess of ten inches in diameter and, therefore, subject to substantial oscillating stresses imposed over a vast number of cycles during the life of the diaphragm 10.

Looking in greater detail to the piston 20, it is shown to include an inflexible core 24. This core 24 may be of material such as aluminum or polymer resin. The core 24 is considered inflexible in the sense that it does not contribute to the flexural operation of the diaphragm 10 and is not subject to fatigue failure over a large number of cycles experienced by the diaphragm 10 during its expected life.

The inflexible core 24, conveniently integrally formed, may be considered as divided into a hub 26 and a tapered circular plate 28. The hub 26 is generally cylindrical with a periphery, a first end 30 and a second end 31. The circular plate 28 extends radially outwardly from the periphery of the cylindrical hub 26 to substantially rigidify the entire piston 20 such that it does not contribute flexure in diaphragm operation. The circular plate 28 has a plurality of holes 32 which are shown in this embodiment to be six in number equiangularly spaced concentrically about the center of the inflexible core 24. A center attachment 34 in the form of a threaded hole in the hub 26 receives the pump shaft 14. A mounting surface 36 extends radially about the concentric threaded hole 34.

A thermoplastic coating 38 is applied about the inflexible core 24. This thermoplastic coating is rigid at temperatures contemplated for diaphragm operation. As such, the coating 38 is closely retained about the inflexible core 24 and extends through the plurality of holes 32. The end of the hub 26 with the center attachment 34 and the mounting surface 36 is not coated by the thermoplastic coating 38.

A unitary diaphragm body 40 is molded with the core 24 and thermoplastic coating 38 in situ. The body 40 defines the outward appearance of the diaphragm 10 including the piston 20 and the peripheral portion 22. Only the one end of the hub 26 is exposed through the unitary diaphragm body 40 and is flush with the surface of the body 40. The body 40 is of thermoplastic elastomer which has at least a thermally miscible surface with the thermoplastic coating 38. It has been found convenient to use material having the same monomer for both the thermoplastic coating 38 and for the thermoplastic elastomer of the body 40 to enhance miscibility and chemical compatibility. The use of compatible thermoplastics and thermoplastic elastomers, including matching monomers, to bond elements together is a technique known in the art.

The structure of the diaphragm body 40 has been developed to provide a rigid piston 20 adhering to the inflexible core 24. To this end, a plurality of connective tendons 42 extend through the plurality of holes 32 to connect and tie the two sides of the body 40 together. An annular ring portion 44 provides the peripheral terminus for the piston 20. This portion 44 is a thick body of thermoplastic elastomer to maintain piston inflexibility. At the outer periphery of the piston 20, the peripheral portion 22 is attached smoothly without significant stress raisers.

Looking to FIG. 3, the diaphragm 10 is assembled with the pump 12 and actuator 16 with the bead 18 positioned there between and compressed using a band clamp 48. The pump shaft 14 includes a threaded end 50 to be received within the center attachment 34. The pump shaft 14 further includes a shoulder 52 which receives an inflexible backing plate 54 such that the backing plate 54 is held against the mounting surface 36 of the piston 20 to further resist flexure. By having the mounting surface 36 free of thermoplastic coating 38, proper fastening torque can be applied to the pump shaft 14 for assembly of the components.

The diaphragms 10 are contemplated to experience a very large number of cycles during their life. Through the use of the inflexible core 24 and the inflexible backing plate 54 brought into juxtaposition with the unitary diaphragm body 40, the piston 20 is able to sustain such use. The configuration of the unitary diaphragm body 40 provides strength at the annular ring portion 44 and through the plurality of connective tendons 42. The holes 32 defining the tendons 42 during the molding process also facilitate flow of material to fully form the diaphragm body 40. The thermoplastic coating 38 applied to the inflexible core 24 before being molded in situ within the unitary diaphragm body 40 miscibly binds with the thermoplastic elastomer of the body 40 and provides a tight and rigid placement about the inflexible core 24. Thus, the thin coating of thermoplastic material 38 also contributes greatly to the integrity of the piston 20 during use.

Thus, an improved diaphragm assembly capable of being of substantial size is disclosed which can sustain long cyclical operation. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A diaphragm assembly for an air driven diaphragm pump, comprising a piston including an inflexible core having a hub with a periphery and a first end, a plate extending radially from about the periphery of the hub and a center attachment concentrically arranged in the hub and accessible from the first end of the hub, the plate defining the inflexibility of the piston, a unitary diaphragm body molded with the inflexible core in situ, the unitary diaphragm body having a plurality of connective tendons extending through the plate, and a thermoplastic coating about the plate and the periphery of the hub also in situ in the molded unitary diaphragm body, the unitary diaphragm body being of thermoplastic elastomer having at least a thermally miscible surface with the thermoplastic coating;

a peripheral flexible portion outwardly of the piston and integrally molded with the unitary diaphragm body.

2. The diaphragm assembly of claim 1, the plate having a plurality of holes there through to receive the connective tendons, respectively, the thermoplastic coating lining the holes.

3. The diaphragm assembly of claim 1, the thermoplastic coating and thermoplastic elastomer containing the same monomer.

4. The diaphragm assembly of claim 1, the unitary diaphragm body further having an annular ring portion of greater cross-sectional thickness than the peripheral flexible portion between the periphery of the plate and the peripheral flexible portion.

5. The diaphragm assembly of claim 1, the first end of the hub including a mounting surface exposed through the unitary diaphragm body.

6. The diaphragm assembly of claim 5, the center attachment being a threaded hole through the mounting surface.

7. A diaphragm assembly for an air driven diaphragm pump, comprising a piston including an inflexible core having a hub with a periphery, a first end and a second end, a plate extending radially from about the periphery of the hub and a center attachment concentrically arranged in the hub and accessible from the first end of the hub, the plate defining the inflexibility of the piston, a thermoplastic coating fully about the plate, the second end and the periphery of the hub, and a unitary diaphragm body of thermoplastic elastomer having at least a thermally miscible surface with the thermoplastic coating and being molded with the inflexible core and the thermoplastic coating in situ, the unitary diaphragm body fully covering the thermoplastic coating.

8. The diaphragm assembly of claim 7, the thermoplastic coating and thermoplastic elastomer containing the same monomer.

9. The diaphragm assembly of claim 7, the first end of the hub including a mounting surface exposed through the unitary diaphragm body, the center attachment being a threaded hole through the mounting surface.

10. The diaphragm assembly of claim 9 further comprising a pump shaft having a threaded end engaged with the threaded hole and a shoulder;

an inflexible backing plate held between the mounting surface and the shoulder on the pump shaft and extending into juxtaposition with the annular ring portion.

11. A diaphragm assembly for an air driven diaphragm pump, comprising a piston including an inflexible core having a hub with a periphery, a first end, a second end and a plate extending radially from about the periphery of the hub defining the inflexibility of the piston, a thermoplastic coating fully about the plate and the periphery of the hub, a unitary diaphragm body molded with the coated inflexible core in situ, the unitary diaphragm body being of thermoplastic elastomer having at least a thermally miscible surface with the thermoplastic coating made integral with the thermoplastic coating;

a peripheral flexible portion outwardly of the piston and integrally molded with the unitary diaphragm body.

12. The diaphragm assembly of claim 11, the thermoplastic coating and thermoplastic elastomer containing the same monomer.

13. The diaphragm assembly of claim 11, the plate having a plurality of holes there through, the thermoplastic coating lining the holes, the unitary diaphragm body further having a plurality of connective tendons extending through the plurality of holes.

* * * * *